US005478214A

United States Patent [19]

Howarth et al.

[11] Patent Number: 5,478,214

[45] Date of Patent: Dec. 26, 1995

[54] COMPACT REDUNDANT COOLING MODULE AND METHOD

[75] Inventors: William B. Howarth, Barrington; William B. Howarth, Island Lake, both of Ill.; Richard J. Bursh, Sharon, Wis.

[73] Assignee: Illinois Blower, Inc., Cary, Ill.

[21] Appl. No.: 193,803

[22] Filed: Feb. 9, 1994

[51] Int. Cl.[6] ..... F04B 23/04

[52] U.S. Cl. ..... 417/423.5; 417/426; 415/60

[58] Field of Search ..... 417/423.1, 423.5, 417/426; 60/39, 83; 415/60; 123/41, 49

[56] References Cited

U.S. PATENT DOCUMENTS

| | | | |
|---|---|---|---|
| 276,360 | 4/1883 | Cory . | |
| 869,868 | 10/1907 | Spencer | 417/423.1 |
| 1,274,319 | 7/1918 | Parsons et al. . | |
| 1,294,437 | 2/1919 | Flanders . | |
| 2,108,738 | 2/1938 | Allen | 415/60 |
| 2,112,090 | 3/1938 | Hanschke . | |
| 2,634,048 | 4/1953 | McDonald | 415/60 |
| 3,735,593 | 5/1973 | Howell . | |
| 4,025,224 | 5/1977 | Starbard . | |
| 4,977,862 | 12/1990 | Aihara et al. . | |
| 5,196,746 | 3/1993 | McCabria . | |

FOREIGN PATENT DOCUMENTS

| | | | |
|---|---|---|---|
| 0802628 | 2/1981 | U.S.S.R. | 415/60 |

*Primary Examiner*—Richard A. Bertsch
*Assistant Examiner*—William Wicker
*Attorney, Agent, or Firm*—Mathew R. P. Perrone, Jr.

[57] ABSTRACT

A compact redundant cooling module has four fans operated by two electric motors, one electric motor serving to operate two fans at one time to cool a heavy industrial engine as required for efficient operation; the other motor and pair of fans being rotated but not operated, in order to provide a backup system.

20 Claims, 6 Drawing Sheets

FIG. 6
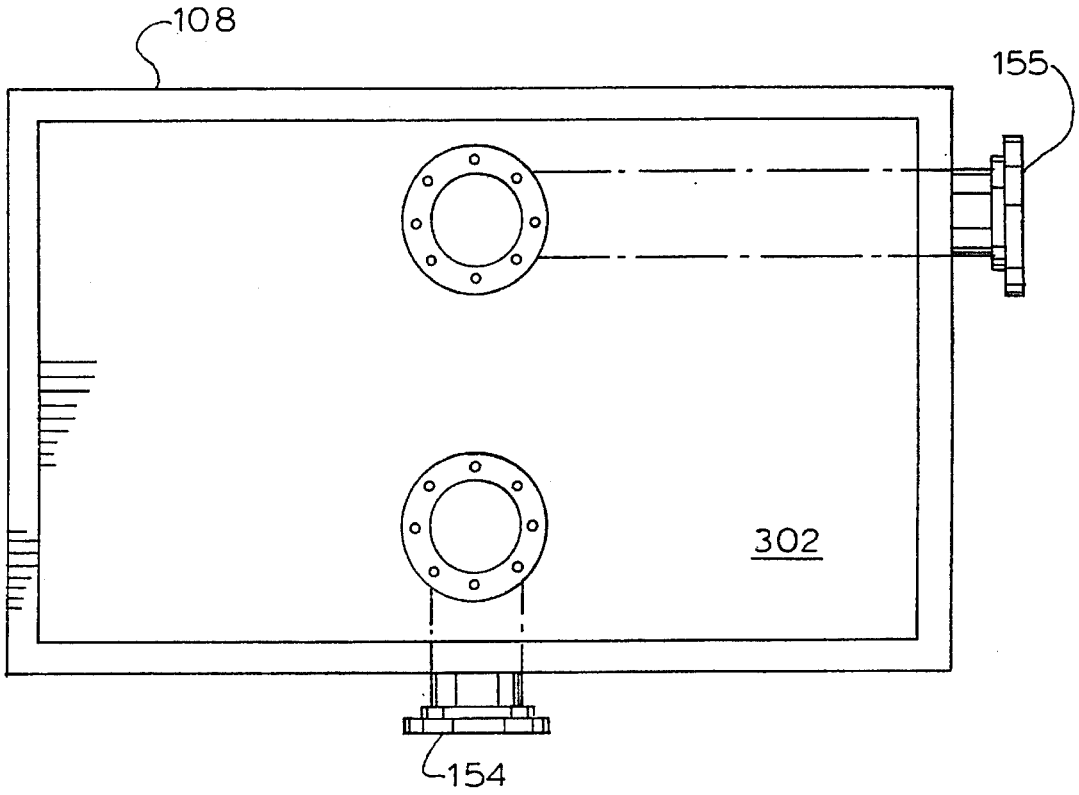
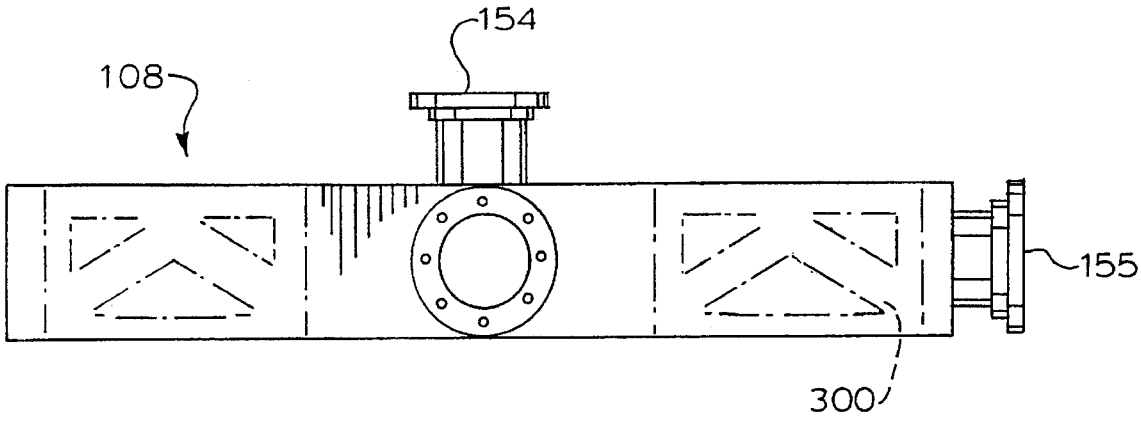
FIG. 7

COMPACT REDUNDANT COOLING MODULE AND METHOD

This invention relates to a cooling device, and more particularly to a method for, and a compact redundant cooling module including a redundant system for, cooling a heavy industrial engine, such as a turbine engine.

BACKGROUND OF THE INVENTION

In many industrial applications, proper cooling of machinery is essential for efficient functioning of the machinery. Adequate cooling for the machinery must be provided without unduly complicating the structure or overall manufacturing process. Thus, industrial cooling can be a major problem.

As a particular example of a cooling problem, a turbine engine may be cited. A turbine engine is a very important part of many, heavy-duty industrial procedures. Most turbine engines may well have heavy-duty industrial applications, in view of their high power to weight ratio. A turbine engine may be used for generating electrical power or directly operating factory machinery.

Whatever its use, the turbine engine generates a sufficient amount of heat so as to require an extensive cooling system. Not all turbines require a separate cooling system. Some have built in cooling systems others such as those associated with this module require additional cooling. Since these turbine engines cannot operate without a cooling system, it is highly critical that the chances of failure for a cooling system be greatly reduced. This reduction of failure chance is accomplished best by redundancy.

While redundancy provides a very desirable backup system, it can still create a problem. One main problem created is that a machine with a redundant capability, must have a great size in that a number of systems are duplicated. This size requires a substantial amount of space, in order to achieve the desired cooling protection and other appropriate advantages. Such space can be at a premium. Thus, it is desirable to reduce the size of the cooling system while at the same time providing for the redundancy and minimize chances of failure.

Customarily, each of these turbine style engines are cooled by a series of four fans each operated by its own electric motor. The structure of the fans and the electric motor adds to the complication of the structure and creates a substantial requirement for space. Thus, the solution to the problem of cooling the turbine engine complicates the space factor. If the cooling of the turbine engine can be accomplished without great sacrifice in space, a great advantage can be obtained.

Additionally the electric motor must be cooled properly in its environment with the turbine engine. The electric motor provides power for cooling the turbine engine. Failure of that electric motor clearly means that the turbine engine cannot be operated.

This electric motor cooling is hypercritical because without it, the electric motor will overheat. When the electric motor overheats, the insulation in the electric motor fails. Then a complete electric motor failure occurs. Not only is this electric motor expensive in its own right, the economic and production losses incurred when a turbine engine is additionally required to be shut down are substantial. Thus, the cooling factor for an electric motor is a major concern for many reasons.

With cooling devices of the prior art, this function can only be accomplished by using four separate fans connected to four separate drive or electric motors. That is to say, each fan of the prior art has its own electric drive motor. Each electric motor is of substantial size and requires a great deal of space.

Each of the electric motors of the prior art also includes an integral electric motor cooling fan. The prior art requires that two of the four electric motors must be operated simultaneously to produce the required process air to cool the turbine engine. If the turbine engine is not properly cooled, severe damage to the turbine engine can result.

Reliability is also a major concern for users of these types of cooling machinery. One major potential source of problems is the bearings used in the electric motors. The cooling apparatus and the turbine engine both produce vibrations. With just one electric motor operating at any time, the vibration thus produced can be detrimental to the bearings in any other electric motor, which is not operating.

When the bearings in the unused electric motor and fan are not rotating while under an inherent heavy static load and vibration, problems can arise. Such a static load in combination with the vibration can produce hard spots on the inner race of the bearing. Each of these hard spots is known as brinelling. In other words, the problem caused by the particular setup required to cool the turbine engines is injurious or damaging to the standby electric motor.

When the fan is rotating, such wear does not occur. However, if the fan is rotating and in operation, the lack of stand-by availability of the backup system becomes apparent. If the system is not backed up by a reliable fan, which has minimal running hours on it, the backup factor and redundancy factor set forth are not met.

So, the complex cooling factors of the turbine engine mitigate accomplishing the required cooling efficiently. The size of the cooling apparatus is one problem. The number of electric motors required for the cooling adds to the inefficiency. Thus, a compact, efficient cooling module can solve many problems in the art.

SUMMARY OF THE INVENTION

Among the many objectives of this invention is the provision of a compact redundant cooling module for a turbine or other machine, which operates four fans with two electric motors with a redundancy factor providing minimized wear and improved reliability.

Another objective of this invention is to provide an apparatus with minimized wear on the redundant part of the apparatus.

Yet another objective of this invention is to provide an apparatus, which efficiently cools a turbine engine.

Still another objective of this invention is to provide an apparatus for reducing shutdown time on an engine.

Additionally, an objective of this invention is to provide a compact redundant cooling module device, which avoids brinelling of a bearing.

Also, an objective of this invention is to provide a compact redundant cooling module device having a reduced size.

A further objective of this invention is to provide a compact redundant cooling module, part of which can rotate without being in operation.

A still further objective of this invention is to provide a method for cooling a turbine engine.

Yet a further objective of this invention is to provide a method for reducing the size of compact redundant cooling module.

Another objective of this invention is to provide an efficient apparatus to cool a turbine engine.

Yet another objective of this invention is to provide an efficient industrial cooling apparatus.

Still another objective of this invention is to provide an industrial cooling apparatus having a reduced size.

These and other objectives of the invention (which other objectives become clear by consideration of the specification, claims and drawings as a whole) are met by providing a compact redundant cooling module having four fans operated by two electric motors, each electric motor serving to operate two fans to cool the engine as required for efficient operation.

BRIEF DESCRIPTION OF THE DRAWINGS

FIG. 6 depicts a top plan view in partial cross-section of the base 108 for the cooling module 100 of this invention.

FIG. 7 depicts a side view in partial cross-section of the base 108 for the cooling module 100 of this invention.

Throughout the figures of the drawings, where the same part appears in more than one figure of the drawings, the same number is applied thereto.

DESCRIPTION OF THE PREFERRED EMBODIMENTS

Figure 1:
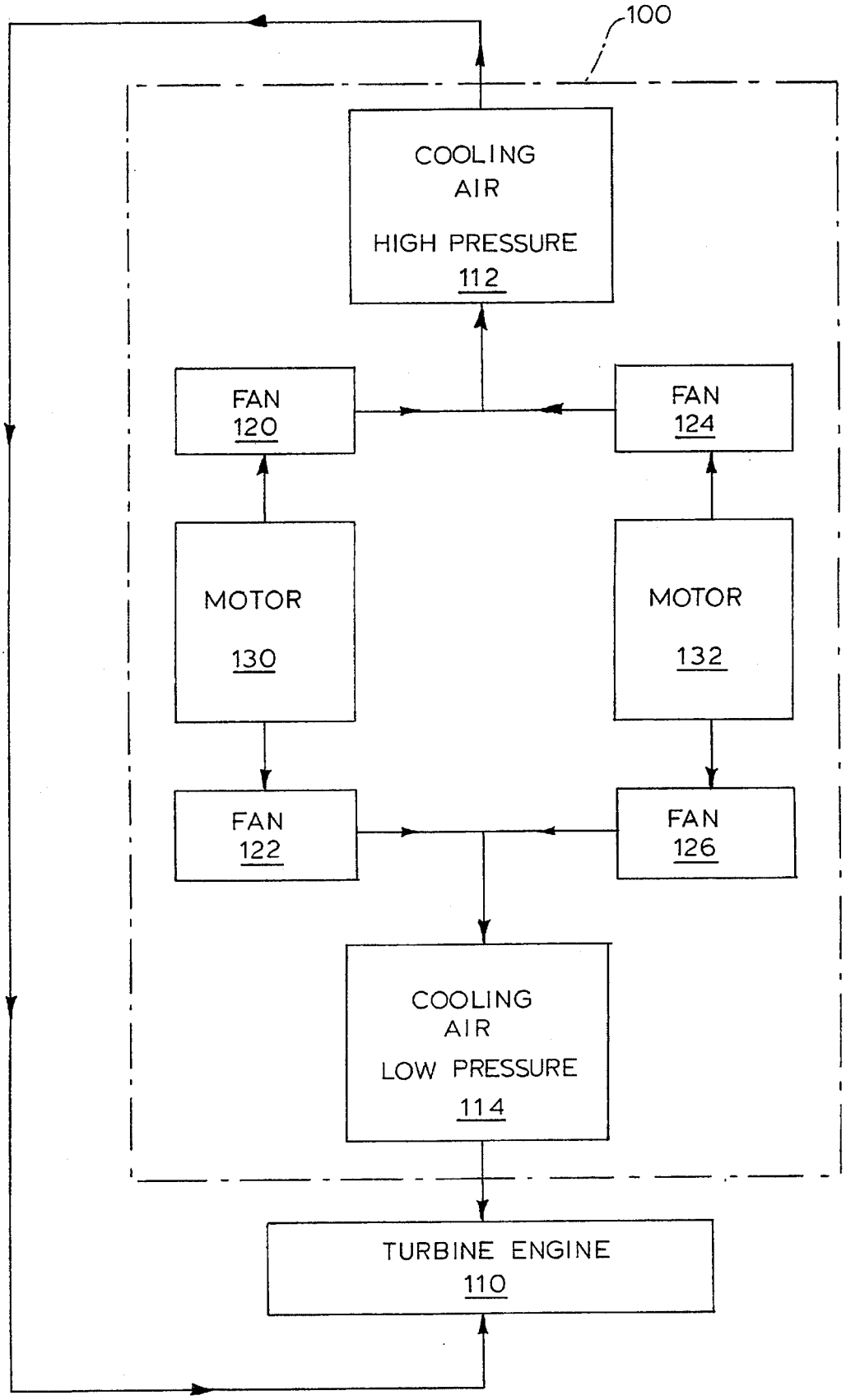
FIG. 1 depicts a block diagram indicating the operation mode of the compact redundant cooling module 100 of this invention and its function in relation to a turbine engine 110.

The compact redundant cooling module of this invention provides two different air supplies at two pressures with a one hundred percent back-up redundant capability, utilizing only two electric motors. These two distinct air supplies can be used with various devices or for various processes, such as cooling a hot exhaust stack or supplying combustion air to a burner. The compact redundant cooling module is especially suitable for cooling a turbine engine.

In this compact redundant cooling module, two electric motors do the work of four. An electric motor is modified, thereby producing a single electric motor with a fan at each end of the electric motor. In order to achieve this design, a cooling fan now provides both process air and electric motor cooling. Only one electric motor is operated at any time to produce the two required, distinct, air supplies with the module of this invention.

Two fans are mounted with one fan at each end of the two electric motors. One fan is a low pressure fan capable of producing a low pressure air flow. The second fan is a high pressure fan capable of producing a high pressure air flow. While both a high pressure fan and a low pressure fan are known in the art, this combination thereof for the particular use is part of the invention herein, such combination being heretofore unknown in the art.

The two fan assemblies consisting of a high pressure fan, electric motor, and low pressure fan, are mirror images of each other. The two high pressure fans discharge into a common duct in the base of the cooling module. The two low pressure fans also discharge into a common duct in base. Since only one electric motor is operational at any time a diverter check valve is used at the connection of the fans to the duct in order to prevent backflow of air into the inactive blower assembly.

Since reliability is also a major concern for users of this type of product, an air operated turning system, which slowly rotates the second part of the cooling module and which is not operating while the first part of the module is operating, minimizes chances of damage to the redundant or back-up system. Because of the new combination of the fans the overall size of the product is reduced by at least one third from the four fan package. This compact redundant cooling module is more compact, reliable, and efficient than any earlier configuration.

To accomplish the required cooling with the use of only two electric motors, a dual flow fan is used. The electric motor typically used on this application is a modified version of a totally enclosed fan cooled electric motor for the use with the compact redundant cooling module. As the electric motor operates, it cools itself with the low pressure fan and causes a high pressure fan to function.

In the prior art a standard totally enclosed fan cooled electric motor incorporates a small centrifugal impeller mounted on a short shaft on the opposite drive end of the electric motor. This centrifugal impeller is protected by a electric motor end bell cover. Electric motor cooling is provided by this small impeller acting as the low pressure fan and moving air over the cooling fins of the electric motor. This cooling air for the electric motor must be maintained or the electric motor can overheat and cause the insulation of the electric motor to fail resulting in a complete electric motor failure.

In order to provide two distinct air supplies from the product with only two electric motors, the backside drive shaft of the electric motor is utilized, while still providing cooling air over the electric motor fins. This dual flow design removes the electric motor end bell cover and small impeller and replaces it with a full size fan impeller and a specially designed fan housing. A typical centrifugal fan housing directs all of the air to the process ductwork.

This housing and impeller combine to produce the air required for the outside process and the cooling air required by the electric motor. The primary air flow from this fan is used for outside processes while the secondary flow is used for cooling the electric motor. The secondary air flow is produced by designing the fan impeller to yield the total of the process air and the electric motor cooling air requirement.

The housing of the fan then directs process air into the process ductwork and the electric motor cooling air through a series of specifically sized holes in the drive side of the fan housing, which dissipate the static pressure of the fan and allow the required amount of electric motor cooling air out of the fan housing. This electric motor cooling is then directed over the electric motor fins by means of a cylindrical shroud around the electric motor end bell.

The electric motor cools both itself and the turbine bearing. The electric motor also drives a fan to cool the exhaust frame of the turbine, thereby cooling the turbine itself. Other fans and structure, not a part of this invention may add to the cooling of the turbine.

An air-operated turning system provides a rotation mechanism for the non-operating fan and electric motor. This rotation is desirable to eliminate or reduce bearing wear or deterioration, which can be caused by vibration from the operation of the other fan and electric motor. The vibration is caused by either the cooling module operational fan, or the turbine being cooled or other operational mechanical equipment. Such bearing wear or deterioration is commonly known as brinelling.

Brinelling of the bearings leads to reduced bearing life span and bearing failure. The brinelling can be avoided by rotating the bearing. To rotate the electric motor which is not operating, the air operated turning system device bleeds off a small amount of high velocity process air from the discharge of the operating fan and directs it through the inactive fan housing at the fan impeller.

The impact of the air on the impeller causes it to rotate slowly in its normal direction of rotation. The bleeding device operates automatically and switches when one blower is turned off and the other is activated. The bleeding device is also capable of reduced flow if slower rotation is desired or complete shut off for maintenance of the inactive fan.

The high velocity air bleeds off through a pipe connected into the fan scroll of the operating fan near the discharge. It then passes through a check valve and flow control valve then into a tube which is routed to a point at the fan cutoff on the scroll. A pipe directs the high velocity air at the impeller. The air impinges on the impeller and causes it to rotate in its normal direction. The check valve is required so that the air can pass in only one direction. This system is duplicated so either electric motor's operation causes the other fan electric motor to rotate.

Referring now to FIG. 1, the compact redundant cooling module 100 is depicted in a block diagram. A turbine 110 is depicted as receiving cooling air 112 and 114. The high pressure cooling air 112 is received alternatively from first fan 120 and third fan 124. The low pressure cooling air 114 is received alternatively from second fan 122 and fourth fan 126. First fan 120 and third fan 124, and second fan 122 and fourth fan 126 are not all operated at same time, unless special circumstances require such action. The resting of one set of fans while the other operates provides the redundancy factor as required.

First electric motor 130 operates both first fan 120 and second fan 122. Second electric motor 132 operates both third fan 124, and fourth fan 126. When first fan 120 and second fan 122 are operated by first electric motor 130, second electric motor 132 does not operate. It follows that, under these conditions neither of third fan 124 and fourth fan 126 are operating, but they are turning to prevent brinelling of the bearings of second electric motor 132.

Also it follows that the majority of the high pressure cooling air 112 cools or provides air to turbine 110 or other engine requiring cooling. Some of cooling air 112 is directed for rotation purposes to the non-operating section of cooling module 100. Such rotation avoids wear to the non-operating section.

Figure 2:
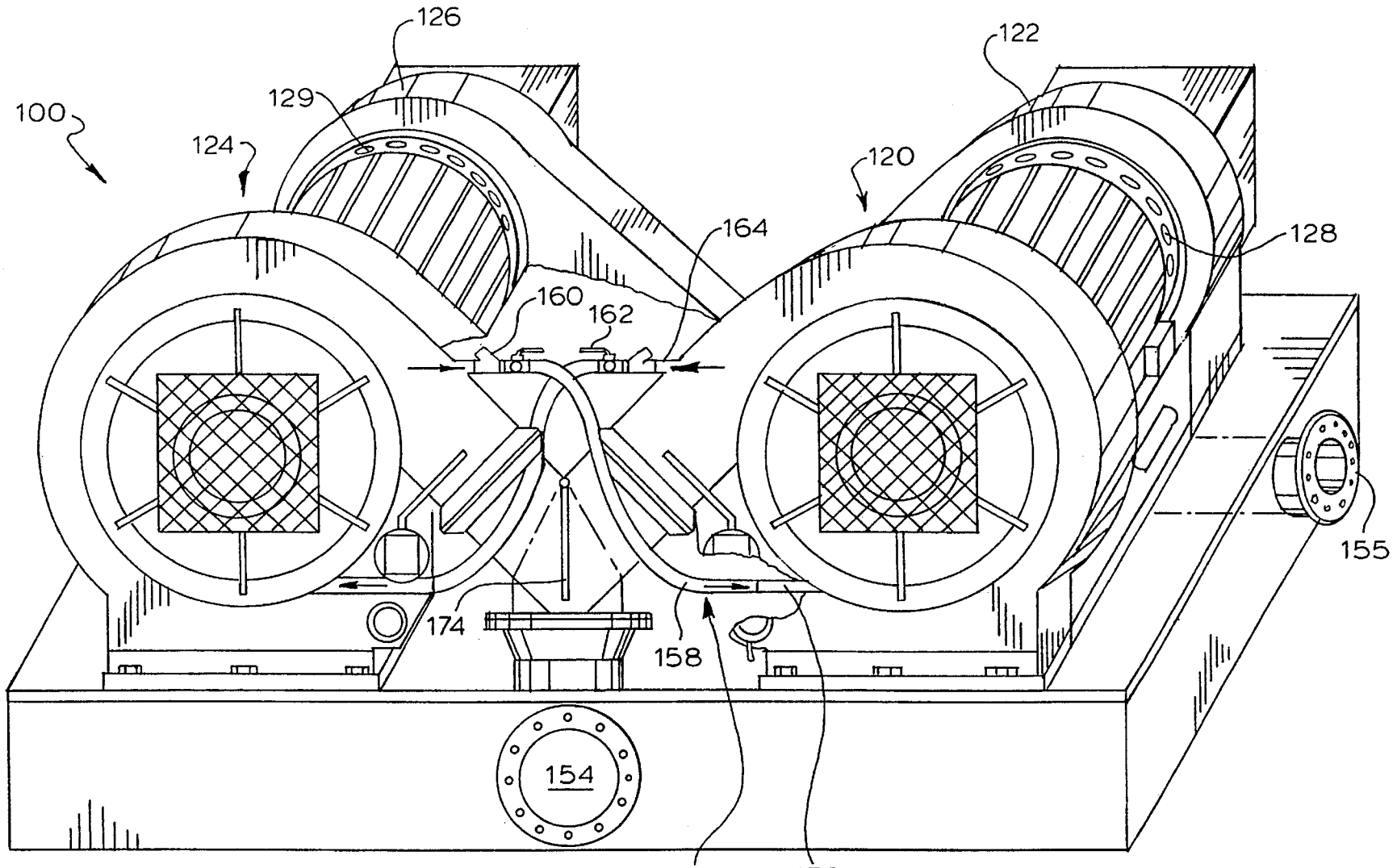
FIG. 2 depicts an end plan view of the cooling module 100 of this invention.
Figure 3:
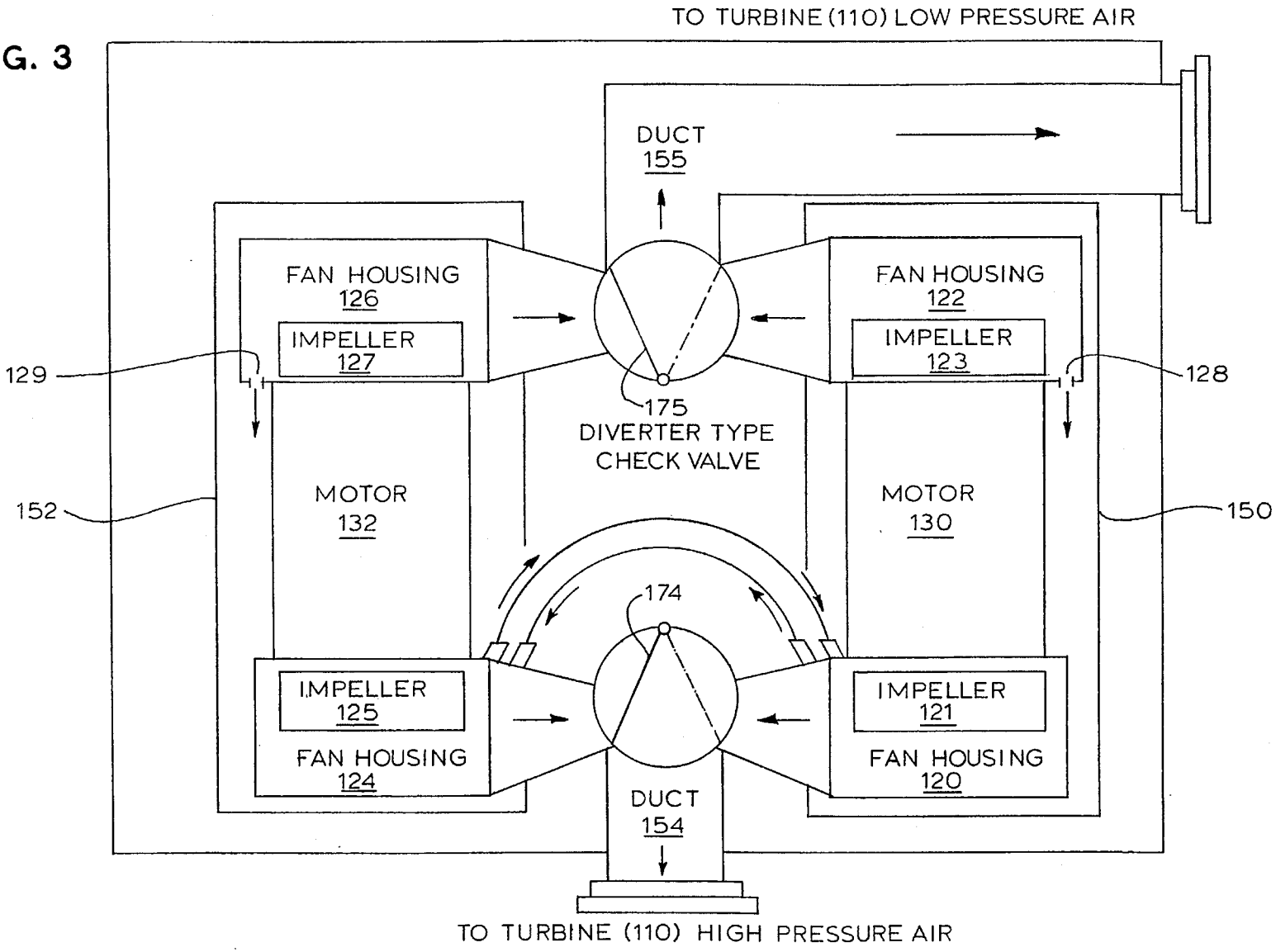
FIG. 3 depicts a top plan view of the cooling module 100 of this invention in partial block diagram form.

Now considering FIG. 2 and FIG. 3 in combination, first fan housing 120 and second fan housing 122 are mounted in a main blower assembly 150. Third fan housing 124 and fourth fan housing 126 are mounted in a primary blower assembly 152. Main blower assembly 150 and primary blower assembly 152 are substantially similar in structure, but are assigned different names and numbers for the purpose of description.

Figure 4:
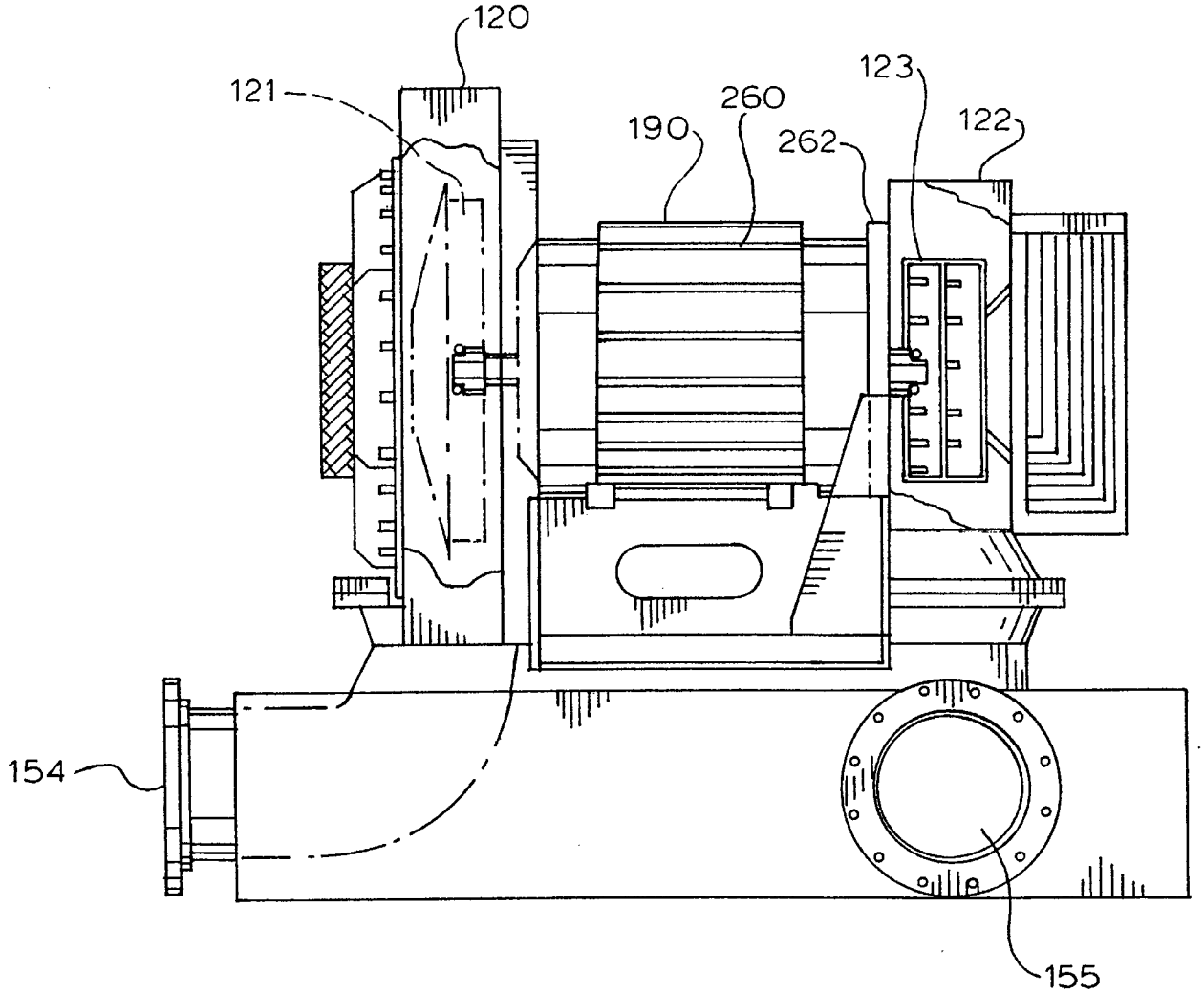
FIG. 4 depicts a side view in partial cross-section of the electric motor 190 together with other parts of the cooling module 100 of this invention.
Figure 5:
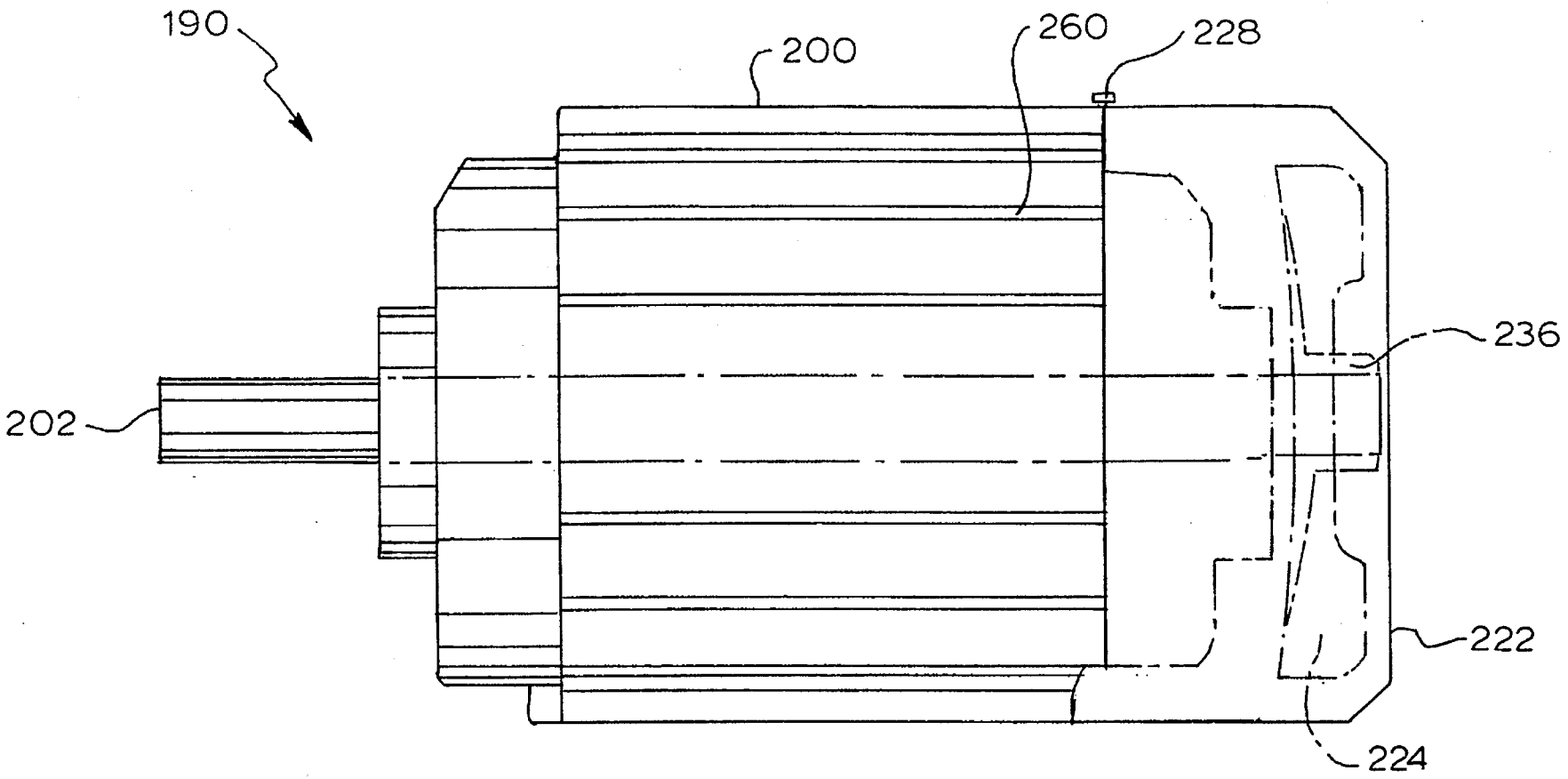
FIG. 5 depicts a magnified view of the electric motor 190 being attached to the base 108 for the cooling module 100 of this invention.

Adding FIG. 4 and FIG. 5 to this consideration, main blower assembly 150 and primary blower assembly 152 are mounted to a common platform which includes ducts 154 and 155 directing air to the turbine 110. Duct 154 is connected to diverter type check valve 174. Diverter type check valve 174 is connected to fan housing 120 and fan housing 124 preventing backflow of air into the inactive blower assembly.

Duct 155 is connected to diverter check valve 175. Diverter check valve 175 is connected to fan housing 122 and fan housing 126 preventing backflow of air into the inactive blower assembly. Each fan housing 120 and 124 is connected to the other fan housing by a tube assembly 156. Each tube assembly 156 includes a hose 158 as the primary connection.

Within the tube assembly 156 is check valve 160, which prevents back flow of the air. A ball valve 162 permits closing of the tube assembly 156. Check valve 160 directs either main blower assembly 150 or primary blower assembly 152, which ever is the non-operating fan to be rotated by air. The hose 158 directs the air from the valves into the fan for rotation purposes.

The tube assembly 156 is connected to the fan housing 124 and the fan housing 120. The hose 158 is connected to the discharge location pipe 164. Discharge location pipe 164 also provides for a connection of the valves to the fan housing 124 in operation. The cutoff location pipe 170 provides for receiving the hose 158 to the fan housing 120 not containing the operating fan. Cutoff location pipe 170 passes through fan housing 120 and directs high velocity air at impeller 121 or 125, whichever is not operating.

Now considering FIG. 5, the desired electric motor 190 for operating the fans includes a frame 200. Clearly electric motor 190 is used for both first electric motor 130 and second electric motor 132. The reference to first electric motor 130 and second electric motor 132 is for proper positioning purposes of each electric motor within the compact redundant cooling module 100.

Mounted in the frame 200 is a shaft 202. Other electric motor components are standard.

In the prior art the fan cover 222 provides an end cover for the electric motor 190 over outer fan 224 on the opposite drive end. The fan clamp 236 secures the outer fan 224 in proper position for cooling the electric motor 190 by propelling air over the cooling fin 260. The fan cover bolts 228 secure the cover 222 and the electric motor 190 in a standard totally enclosed fan cooled electric motor 190.

Modifications of the standard totally enclosed fan cooled electric motor 190 are required for use in the compact redundant cooling module 100. The fan cover 222, the outer fan 224, and the fan clamp 236 are removed, They are replaced by impeller 123 or impeller 127 and fan housing 122 or fan housing 126. The fan housing 122 or 126 includes openings 128 or 129 for the required electric motor cooling air to pass over cooling fins 260 and a shroud 262 to direct the air over the fins 260 for cooling the electric motor 190 in place for use with the compact redundant cooling module 100.

Other features of the electric motor 190 are standard.

Within the electric motor 190 and added thereto for this invention to increase the redundancy capabilities is the electric motor cooling capacity. Part of the air propelled by the impeller 123 or 127 cools the fin 260 and thereby cools the electric motor 190. The remainder of the air goes to turbine 110 through duct 155.

The drive end shaft 202 receives impeller 121 or 125 which provides air to turbine 110 and provides air to rotate the non operational blower assembly. The opposite drive end shaft 270 receives impeller 121 or 125, which cools electric motor 190 while at the same time provides air to turbine 110.

With the combination of FIG. 6 and FIG. 7, the base 108 to support the cooling module 100 is considered. Base 108 includes a frame 300 with a sheet steel covering 302. Duct 154 and 155 are built into base 108 and deliver air to turbine 110.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A compact redundant cooling module for cooling a heavy industrial engine, comprising:

a) a first fan assembly and a second fan assembly having a first operating assembly and a second operating assembly;

b) the first fan assembly being operated by the first operating assembly;

c) the second fan assembly being operated by the second operating assembly;

d) the first fan assembly being operable independently of the second fan assembly; and e) means to prevent a first wearing mechanism on the first fan assembly and the first operating assembly while inactive and while the second fan assembly and the second operating assembly are operating.

2. The compact redundant cooling module of claim 1 further comprising:

a) the first fan assembly including a first pair of fans;

b) the first operating assembly being a first electric motor operably connected to the first pair of fans;

c) the second fan assembly including a second pair of fans; and d) the second operating assembly being a second electric motor operably connected to the second pair of fans.

3. The compact redundant cooling module of claim 2 further comprising:

a) means to prevent a second wearing mechanism on the second fan assembly and the second operating assembly while inactive and while the first fan assembly and the first operating assembly are operating; and b) a first cooling means for cooling the first electric motor;

c) and a second cooling means for cooling the second electric motor.

4. The compact redundant cooling module of claim 3 further comprising:

a) the first fan assembly providing both the first cooling means for cooling the first electric motor and means for cooling the heavy industrial engine; and b) the second fan assembly providing both the second cooling means for cooling the second electric motor and means for cooling the heavy industrial engine.

5. The compact redundant cooling module of claim 4 further comprising:

a) the first fan assembly providing both low pressure air and high pressure air; and b) the second fan assembly providing both low pressure air and high pressure air.

6. The compact redundant cooling module of claim 3 further comprising:

a) the first fan assembly providing both low pressure air and high pressure air;

b) the second fan assembly providing both low pressure air and high pressure air; and c) the first fan assembly and the second fan assembly being substantially similar in structure.

7. The compact redundant cooling module of claim 6 further comprising:

a) the first fan assembly including a low pressure fan mounted at a first end of the first electric motor and high pressure fan at a second end of the first electric motor; and b) the first end of the first electric motor being oppositely disposed from the second end of the first electric motor; and c) the second fan assembly including a low pressure fan mounted at a first end of the second electric motor and a high pressure fan at a second end of the second electric motor.

8. The compact redundant cooling module of claim 7 further comprising:

a) the means for cooling the heavy industrial engine including a first fan housing for the first fan assembly surrounding the high pressure fan, a common duct, and a base;

b) the base being mounted adjacent to the heavy industrial engine and having the fan housing and the common duct mounted thereon;

c) the means for cooling the heavy industrial engine including a second fan housing surrounding the second fan assembly at the high pressure fan; and d) the common duct communicating with the first fan housing and the second fan housing and the base to convey the high pressure air for cooling the heavy industrial engine.

9. The compact redundant cooling module of claim 8 further comprising:

a) the first fan assembly being an inactive blower assembly while the second fan assembly is operating;

b) the second fan assembly being the inactive blower assembly while the first fan assembly is operating;

c) means for preventing a backflow of air into the inactive fan assembly;

d) the means to prevent a second wearing mechanism including a means for rotating the second fan assembly while the first fan assembly is operated; and e) the means to prevent a first wearing mechanism including a means for rotating the first fan assembly while the second fan assembly is operated.

10. The compact redundant cooling module of claim 9 further comprising:

a) the means for preventing backflow of air into the inactive fan assembly including a diverter check valve;

b) the means for rotating the second fan assembly being a second air operated turning system while the first fan assembly is operated; and c) means for rotating the first fan assembly being a first air operated turning system.

11. The compact redundant cooling module of claim 10 further comprising:

a) the low pressure fans serving to cool the electric motor;

b) the high pressure fans serving to cool the heavy industrial engine; and c) the low pressure, fans each including a centrifugal impeller.

12. The compact redundant cooling module of claim 11 further comprising:

a) fan housings surrounding each low pressure fan, the low pressure fan housings directing cooling air to both the heavy industrial engine and the electric motors;

b) low pressure fan housings each a series of apertures in a drive side of the fan housing in order to dissipate a static pressure of the fan and allow the required amount of cooling air for the electric motor out of the fan housing over the electric motor fins;

c) a cylindrical shroud around the electric motor serving to direct the cooling air; and d) the cooling air serving to cool both the electric motor and a turbine bearing for the heavy duty industrial engine.

13. The compact redundant cooling module of claim 12 further comprising:

a) the air operated turning device bleeding off a small amount of high velocity process air from the discharge of the operating fan and directing the small amount of high velocity process air to the inactive fan housing at a fan impeller contained therein to thereby cause the inactive fan assembly to rotate slowly in a normal direction of rotation; and b) a switching means for the bleeding device to reverse operation as the first fan assembly and the second fan assembly reverse operation.

14. The compact redundant cooling module of claim 13 further comprising:

a) a pipe secured to a fan scroll providing for the bleeding off the high velocity air;

b) the pipe having a check valve and a flow control valve secured opposite the fan scroll;

c) the check valve and the flow control valve being connected to a tube;

d) the tube being routed to the fan cutoff on the scroll to directs the high velocity air at an impeller for the fan to cause rotation of the inactive fan assembly; and e) the check valve serving to require air to pass in only one direction.

15. A compact redundant cooling module for cooling a heavy industrial engine, comprising:

a) a first fan assembly and a second fan assembly having a first operating assembly and a second operating assembly;

b) the first fan assembly being operated by the first operating assembly;

c) the second fan assembly being operated by the second operating assembly;

d) the first fan assembly being operable independently of the second fan assembly;

e) means to prevent a first wearing mechanism on the first fan assembly and the first operating assembly while inactive and while the second fan assembly and the second operating assembly are operating;

f) the first fan assembly including a first pair of fans;

g) the first operating assembly being a first electric motor operably connected to the first pair of fans;

h) the second fan assembly including a second pair of fans;

i) the second operating assembly being a second electric motor operably connected to the second pair of fan;

j) means to prevent a second wearing mechanism on the second fan assembly and the second operating assembly while inactive and while the first fan assembly and the first operating assembly are operating;

k) a first cooling means for cooling the first electric motor;

l) and a second cooling means for cooling the second electric motor;

m) the first fan assembly and the second fan assembly both including a fan scroll;

o) a pipe secured to the fan scroll providing for the bleeding off of air;

p) the pipe having a check valve and a flow control valve secured opposite the fan scroll;

q) the check valve and the flow control valve being connected to a tube;

r) the first fan assembly being an inactive fan assembly while the second fan assembly is operating;

s) the second fan assembly being the inactive fan assembly while the first fan assembly is operating;

t) the tube being routed to the a fan cutoff on the scroll to direct the high velocity air at an impeller for the operating fan to cause rotation of the inactive fan assembly; and u) the check valve serving to require air to pass in only one direction.

16. The compact redundant cooling module of claim 15 further comprising:

a) the first fan assembly providing both the first cooling means for cooling the first electric motor and means for cooling the heavy industrial engine;

b) the second fan assembly providing both the second cooling means for cooling the second electric motor and means for cooling the heavy industrial engine;

c) the first fan assembly providing both low pressure air and high pressure air;

d) the second fan assembly providing both low pressure air and high pressure air;

e) the first fan assembly including a low pressure fan mounted at a first end of the first electric motor and high pressure fan at a second end of the first electric motor; and f) the first end of the first electric motor being oppositely disposed from the second end of the first electric motor; and g) the second fan assembly including a low pressure fan mounted at a first end of the second electric motor and a high pressure fan at a second end of the second electric motor.

17. The compact redundant cooling module of claim 16 further comprising:

a) the means for cooling the heavy industrial engine including a first fan housing for the first fan assembly surrounding the high pressure fan, a common duct, and a base;

b) the base being mounted adjacent to the heavy industrial engine and having the fan housing and the common duct mounted thereon;

c) the means for cooling the heavy industrial engine including a second fan housing surrounding the second fan assembly at the high pressure fall;

d) the common duct communicating with the first fan housing and the second fan housing and the base to convey the high pressure air for cooling the heavy industrial engine;

e) means for preventing backflow of air into the inactive blower assembly;

f) the means to prevent a second wearing mechanism including a means for rotating the second fan assembly while the first fan assembly is operated; and g) the means to prevent a first wearing mechanism including a means for rotating the first fan assembly while the second fan assembly is operated.

18. The compact redundant cooling module of claim 17 further comprising:

a) the means for preventing backflow of air into the inactive blower assembly including a diverter check valve;

b) the means for rotating the second fan assembly being a second air operated turning system while the first fan assembly is operated; c) the means for rotating the first fan assembly being a first air operated turning system;

d) the low pressure fans serving to cool the electric motor;

e) the high pressure fans serving to cool the heavy industrial engine; and f) the low pressure fans including a centrifugal impeller.

19. The compact redundant cooling module of claim 18 further comprising:

a) each fan housing directing process air into the process ductwork and the electric motor cooling air;

b) each fan housing including a series of apertures in a drive side of each fan housing in order to dissipate a static pressure of each fan and allow the required amount of cooling air for each electric motor out of each fan housing over a set of fins for each electric motor;

c) a cylindrical shroud around the electric motor serving to direct the cooling air;

d) the cooling air serving to cool both the electric motor and a turbine bearing for the heavy duty industrial engine;

e) the air operated turning device bleeding off a small amount of high velocity process air from the discharge of the operating fan and directing the small amount of high velocity process air to the inactive fan housing at the fan impeller thereby causing the inactive fan housing to rotate slowly in a normal direction of rotation; and f) a switching means for the bleeding device to reverse operation as the first fan assembly and the second fan assembly reverse operation.

20. In a cooling device module for cooling a heavy industrial engine with a fan and ductwork system, the improvement comprising:

a) a first fan assembly and a second fan assembly. having a first operating assembly and a second operating assembly;

b) the first fan assembly being operated by the first operating assembly;

c) the second fan assembly being operated by the second operating assembly;

d) the first fan assembly being operable independently of and redundantly to the second fan assembly;

e) means to prevent a first wearing mechanism on the first fan assembly and the first operating assembly while the second fan assembly and the second operating assembly are operating;

f) the first fan assembly including a first pair of fans;

g) the first operating assembly being a first electric motor operably connected to the first pair of fans;

h) the second fan assembly including a second pair of fans;

i) the second operating assembly being a second electric motor operably connected to the second pair of fans; and j) means for rotating the second fan assembly while the first fan assembly is operated.

* * * * *